United States Patent [19]

Fox

[11] 4,438,967

[45] Mar. 27, 1984

[54] BAG HANDLE

[76] Inventor: Donald L. Fox, 76 Maple Ave., Greenwich, Conn. 06830

[21] Appl. No.: 289,408

[22] Filed: Aug. 3, 1981

[51] Int. Cl.[3] ..... B65D 33/06

[52] U.S. Cl. ..... 294/164; 229/52 AW; 294/141; 294/165

[58] Field of Search ..... 294/1 R, 16, 27 R, 27 H, 294/103 R, 104, 137, 141, 152–154, 162–170; 16/114 R; 24/30.5 R; 150/4, 6, 12; 229/52 A, 229/52 AM, 52 AW, 54 R, 62

[56] References Cited

U.S. PATENT DOCUMENTS

| | | | |
|---|---|---|---|
| 641,340 | 1/1900 | Smith | 294/164 |
| 824,904 | 7/1906 | Cammett | 294/166 |
| 1,065,972 | 7/1913 | Shaffer | 294/152 |
| 1,625,772 | 4/1927 | Moller | 24/30.5 R |
| 1,977,492 | 10/1934 | Schaaf | 150/12 X |
| 2,337,580 | 12/1943 | Webster | 294/164 X |
| 2,576,259 | 11/1951 | McGuire | 294/165 |
| 2,716,516 | 8/1955 | Weston | 294/165 |
| 3,305,260 | 2/1967 | Phillips | 294/16 |
| 3,937,394 | 2/1976 | Netschert | 294/165 X |

*Primary Examiner*—Johnny D. Cherry
*Attorney, Agent, or Firm*—Perman & Green

[57] ABSTRACT

Apparatus and method for keeping a bag opening closed and providing a handle for carrying the bag. A frame is provided with a handle and a bag engaging portion. The frame is placed over the bag after the opening is closed and the bag engaging portion is placed into position to maintain a portion of the bag against the frame. The frame is then re-oriented, turning the bag back on itself to provide a safe, secure handle for the bag while maintaining it in a closed condition. The bag engaging portion of the frame also has an orientation at which the handle can be used for carrying tied packages.

9 Claims, 9 Drawing Figures

FIG. 1
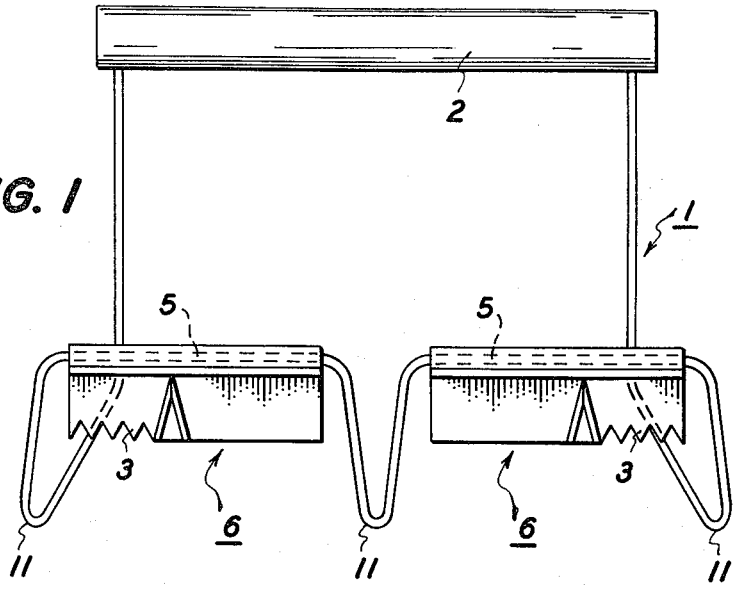
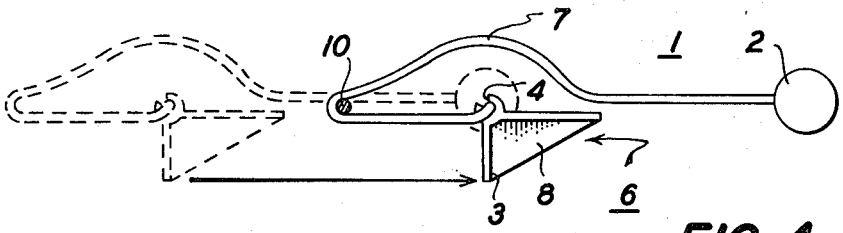
FIG. 4
FIG. 2a
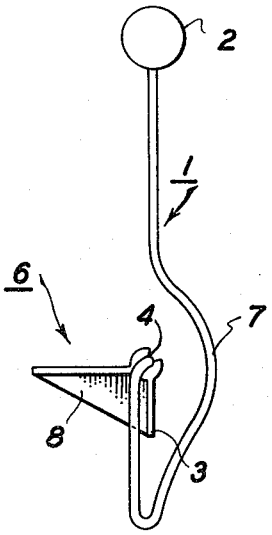
FIG. 2b
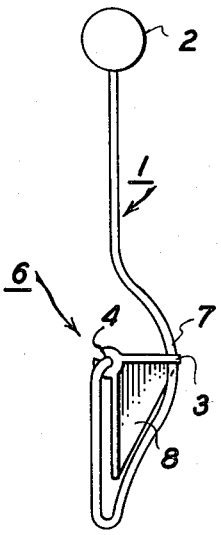
FIG. 2c
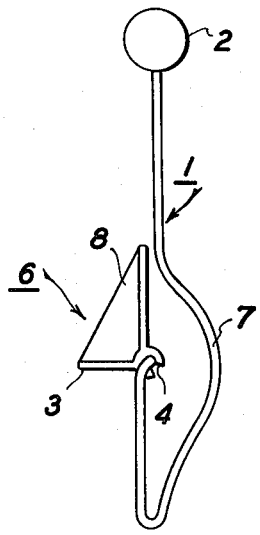

1
2
3
4
6
7
8
9

BAG HANDLE

BACKGROUND OF THE INVENTION

This invention relates generally to a bag handle, and more particularly, to a handle for keeping the bag opening closed and providing a secure engagement with the bag so that the bag may be safely lifted by the handle.

Ordinary bags and the like, especially those made of paper which are used to carry heavy articles, generally do not have carrying handles or means to keep the bag opening closed. Such bags, for instance, those provided by supermarkets to carry groceries, are generally carried in one's arms with the opening left open when they contain articles. In addition to being awkward, when the bags are partially or fully loaded with contents and are placed in a car or the like for transport, the contents tend to spill out of the bag if the bag for some reason is tipped or lays over on its side. There is generally no bag locking or closing means which would prevent the contents from falling out under these conditions.

An object of the invention is to provide handles for bags and other similar carrying containers which do not otherwise have provision for carrying by the hand.

Another object of the invention is to provide a closing device for bags and the like so that the contents do not spill out even though the bags are tipped onto their sides.

Another object of the invention is to provide a combination device which serves as a handle to be placed on bags for carrying purposes and which also can be used to carry tied packages.

SUMMARY OF THE INVENTION

A method and apparatus for providing handles on bags and the like and for keeping the bag opening closed. A frame means having a carrying means at one portion thereof is placed on the closed bag opening and secured to the bag. The frame means is then re-oriented turning a portion of the bag at least partially back on itself. After re-orienting the frame means, any force placed on the bag, such as by the weight of the articles therein, tends to cause the grip of the frame means on the bag to become stronger. The bag opening is maintained closed when the frame means is on the bag. The frame means is also adapted to be readily inserted onto tied packages for carrying purposes.

BRIEF DESCRIPTION OF THE DRAWINGS

Other objects and advantages of the present invention will become apparent upon reading the following detailed description with reference to the drawings wherein:

FIG. 1 illustrates a front view of a preferred embodiment of the bag handle.

FIG. 2*a* illustrates a side view of the apparatus showing the position of the pivoting member when the frame is placed on the bag.

FIG. 2*b* illustrates a side view of the apparatus showing the position of the pivoting member when the bag is locked to the frame.

FIG. 2*c* illustrates a side view of the apparatus showing the position of the pivoting member when the handle is being used with tied packages.

FIG. 4 illustrates the position of the pivoting member as it is inserted onto a tied package to act as a handle therefor.

Figures 3A, 3B, 3C, 3D:
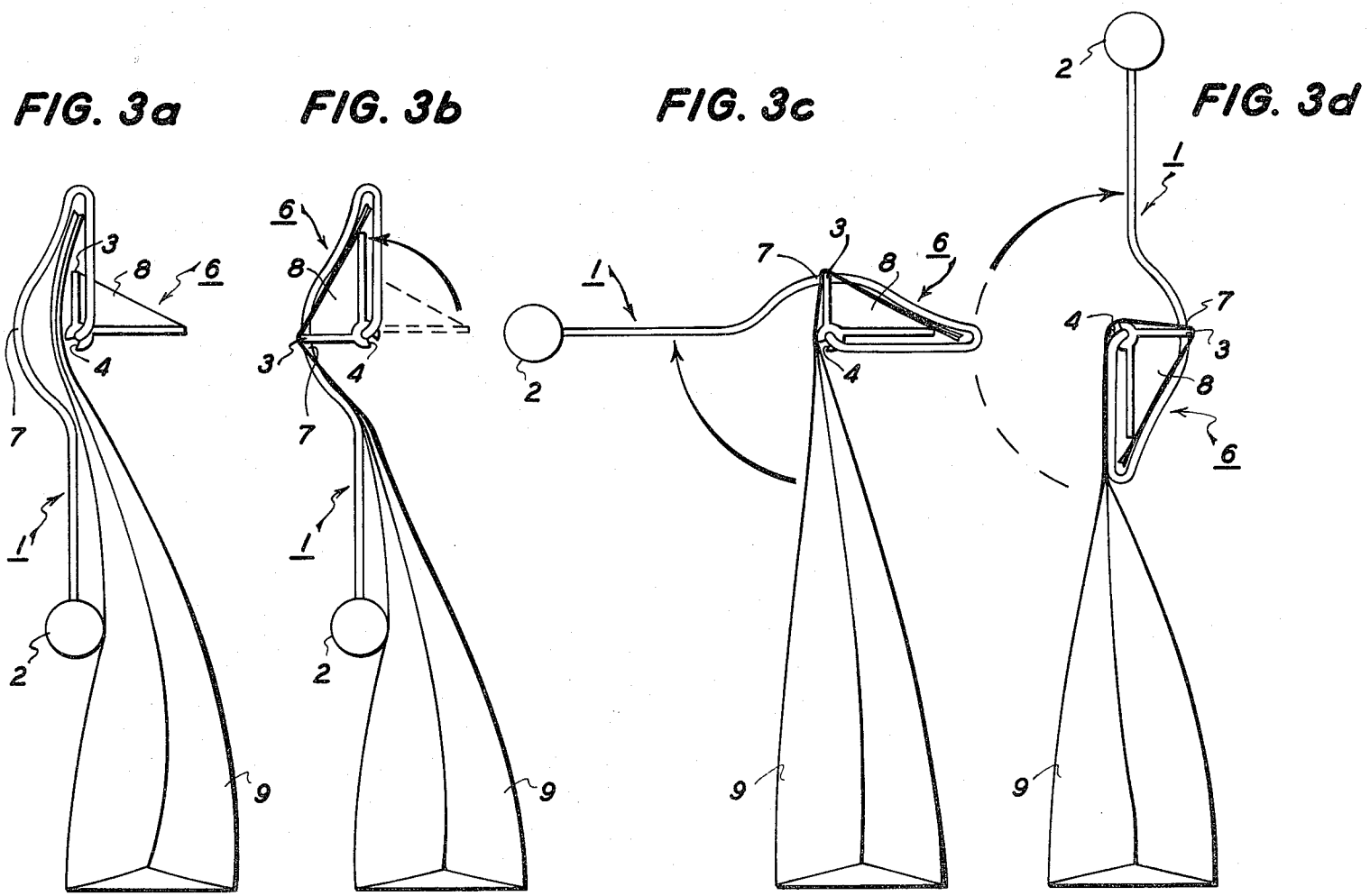
FIG. 3*a* shows the position of the frame and pivoting member as the frame is slipped onto the closed bag opening.
FIG. 3*b* shows the position of the frame and pivoting member after the pivoting member has been locked into the bag.
FIG. 3*c* shows the position of the frame as the closed bag opening is being turned back on itself.
FIG. 3*d* illustrates the position of the frame and closed bag opening when the bag is ready to be carried by the handle.

While the present invention is described in connection with a preferred embodiment and associated method of use, it should be understood that it is not intended to limit this invention to this embodiment and method of use. On the contrary, it is intended to cover all alternatives, modifications and equivalents as may be included within the spirit and scope of the invention as defined by the appended claims.

DETAILED DESCRIPTION OF THE INVENTION

Referring more particularly to the drawings, wherein like reference numerals have been used throughout to designate like elements, FIGS. 1 and 2 illustrate schematically one embodiment of the bag handle apparatus. The bag handle is a quick-attach device for carrying bags such as ordinary paper bags and the like. It is also adapted to carry tied packages.

Referring to FIG. 1, the apparatus has three major components in this embodiment; frame 1, handle 2 and at least one pivoting member 6. The embodiment shown in FIG. 1 contains two pivoting members. Frame 1 can be made of any suitable material, such as a material of relatively narrow cross-sectional area as shown in the drawing. A single piece of bent wire is suitable for the frame. The frame may be bent into the shape shown in FIG. 1, the features thereof which are explained in more detail below. Located at one end of the frame is handle 2, which can be made of any suitable material such as plastic. The frame can be made of snap into openings on handle 2. The handle is preferably long enough to accommodate a hand so that the bag can be held comfortably.

The frame, on the end opposite the handle, has three frame loops 11 and two pivoting members, generally designated 6. The pivoting members can be made of any suitable material and can be joined to the frame in any suitable manner. For instance, they can be made of a strong plastic material having mounting slots 4. The slots can be snapped onto the wire of frame 1 and still turn freely thereabout.

The pivoting members contain engagement means 3, shown in this embodiment as teeth; and guide 8. Each pivoting member is mounted on pivoting member mount sections 5 of frame 1.

Pivoting member 6 has three different positions shown in FIGS. 2*a*–2*c*. The first is as shown in FIG. 2*a*. This is the position taken when the bag handle is initially placed on the closed bag opening. The bag is allowed to slip into the loop portions of the frame without interference with teeth 3. The second position of the pivoting member is shown in FIG. 2*b*. In this position, the member locks the bag to the frame. The third position of pivoting member 6 is shown in FIG. 4. This position enables the pivoting member to slip between the tie material of a tied package. The tie material, such as string, twine or the like, is slipped into the loop portion of the frame.

In the second position, shown in FIG. 2*b*, the pivoting member can be rotated until teeth 3 engage stop position 7 on the frame. The frame can have a definite bend at this position to better engage the teeth. For instance, an approximate right angle bend is shown in the drawings. In the pivoting member stop position, the tooth and frame become engaged at approximately point 7. The teeth circumscribe the wire frame in this position when there is no bag in the frame.

The steps taken to install the handle on a bag are depicted in FIGS. 3*a*–3*d*. Beginning with FIG. 3*a*, the normally open end of the bag is closed and, while pivoting member 6 is in the first position, the handle is slipped over the closed end of the bag until the top of the bag seats itself approximately in the area of the loops on the frame. After this is completed, the operator rotates pivoting member 6 in the counter-clockwise direction, as shown in the view of FIG. 3*b*, to cause teeth 3 to place the adjacent portion of the bag into intimate contact with frame 1 in the vicinity of stop point 7. The bag is now engaged into the handle.

Next, the operator re-orients the bag handle as shown in FIG. 3*c*. In this embodiment, re-orientation is simply accomplished by bringing the handle portion 2 of the bag device around approximately 180 degrees in the clockwise direction as shown by the arrow. As this occurs, the top portion of bag 9, which continues to be maintained against frame 1 by teeth 3, is turned back on itself approximately 180 degrees. Referring finally to FIG. 3*c*, handle 2 is brought to its full upright position over the bag, and the bag top is brought to a completely closed position where it is maintained by the frame.

The handle provides assurance that the bag cannot slip out of the device. In the position shown in FIG. 3*d*, the weight of the bag and its contents tend to pull down away from the handle as it is being lifted. The bag does not slip or in any way work itself free of the handle at this time because of the geometry of the bag relative to the handle. Any downward force provided by the bag and its contents through gravity tends to further engage teeth 3 with the bag and more firmly hold the bag against the frame. As a result, the heavier the bag, the more securely the handle holds it.

The two top edges of the bag are held closed by the bend of the wire frame at point 7. Loops 11, in the frame, are oriented so that they place a twist in the bag portion that is inserted therein. This twist also serves to keep the bag opening closed. The pivoting lock pieces are then pressed into the stop, thus securing the top of the bag through the engagement of the teeth which are part of pivoting member 6.

The position shown in FIG. 3*d* is the carrying position. In this position, a fold is created in the top of the bag at approximately $\frac{3}{4}''$ from its top edge. The crease of this fold rests on the pivoting edges of the locking mechanism. Consequently, when the bag is being carried by a handle above it, the tendency of the weight of the bag is to force the teeth against the top of the bag thereby guaranteeing that there is no slippage of the lock. Because of the design, the bag is maintained closed for carrying once the bag handle is installed. The bag may be either carried out placed on its side without having its contents spill out. It is also easy to hold more than one bag in each hand when using the bag handle.

The bag handle also functions as a carrying device for tied packages. To be used in this manner, the pivoting members take on the position shown in FIG. 2*c*. In this position, a clear passageway is opened for rope, string, or like tie material to be engaged by the handle device. The tie slides into the loop at the bottom of the handle device. An easy way to accomplish this is to place the handle horizontally on the package top shown in FIG. 4. Starting in the dotted line position, the handle is moved toward tie 10. By placing the half-round guides of the pivoting member toward the tie, they scoop up the tie and direct it through the frame and down into the loops of the frame. If the device is engaged where the tie crosses in a tied package, middle loop 11 engages the cross tie. When the handle device is fully installed on the tie and the tie is in the loop portions of the frame, the handle is turned vertically and the package can be readily carried by the handle.

It can be appreciated that a great variety of thicknesses are accommodated by the device described herein. It can also be appreciated that in addition to ordinary paper bags, bags of any suitable material can be used with the device. The device prevents slippage between the handle and the bag. It has been found that the bag gives out rather than the handle losing its grip on the bag.

It should be understood that the foregoing description is only illustrative of the invention. Alternatives and modifications of the structural and functional features of the bag handle device can be devised by those skilled in the art without departing from the invention. Accordingly, the present invention is intended to include all such alternatives, modifications and variances which fall within the spirit and scope of the appended claims.

What is claimed is:

1. Apparatus for keeping a bag opening closed and providing a handle for carrying the bag comprising:

(a) frame means having a first portion thereof for gripping the bag and a second portion thereof for carrying the bag;

(b) means for engaging the bag opening with the frame means in the vicinity of the first portion of the frame means whereby after the bag is engaged, any force tending to pull the bag off of the frame means places more force on the engagement means; and (c) said first portion of said frame means including a stop, said engaging means including a non-spring-biased rotatable member extending transversely of said frame means for support of the bag, said member being mounted on said first portion of said frame means at a site spaced apart from said stop to provide an entry space for entry of said bag between said member and said stop and frame means, said rotatable member having an edge with gripping means movable towards said stop into said entry space for gripping the bag upon rotation of said member.

2. Apparatus for keeping a bag opening closed and providing a handle for carrying the bag comprising:

(a) frame means having a bend therein for receiving bag material;

(b) handle means on one side of said bend on the frame means;

(c) at least one non-spring biased rotatable member means for engaging the bag opening on another side of said bend in said frame means, said rotatable member means extending transversely of said frame means for support of said bag;

(d) means for mounting the rotatable member means on said another side of said bend on the frame means; and (e) a stop spaced apart from said mounting means in said bend on said frame means to provide an entry space for entry of said bag between said member means and said stop, said rotatable member means having a portion for gripping said bag movable towards said stop upon rotation of said member means in a direction opposite the direction of insertion of the bag into said entry space for engaging the bag.

3. The apparatus as in claim 2 wherein the member means has tooth means to engage a portion of the bag and maintain it against the frame means.

4. The apparatus as in claim 3 wherein the member means pivots relative to the frame means placing a portion of the bag against the frame means after the frame means is engaged on the bag whereby the bag is maintained between the frame means and the tooth means on the member means when the frame means is carried by its handle means.

5. The apparatus as in claim 4 wherein the member means further includes a guide surface to maintain the portion of the bag adjacent the member means in a position substantially against the frame means.

6. Apparatus for keeping a bag opening closed and providing a handle for carrying the bag and for also carrying tied packages comprising:

(a) frame means, (b) a handle means mounted on a first portion of the frame means, (c) a non-spring-biased rotatable member means for engaging the bag and maintaining the bag opening closed, said member means extending transversely of said frame means for support of said bag, (d) means for mounting the member means on a second portion of the frame means, and (e) means on the frame means opposite the first portion of the frame means for engaging the tie material of tied packages; the rotatable member means having three orientations, a first at which the frame means can be readily slipped over the closed bag opening, a second at which the closed bag is maintained against the frame means, and a third at which the frame means can be readily guided between the tie material and the package to engage the tie material for carrying purposes; and wherein rotation of said member means relative to said frame means from said first orientation of said second orientation is accomplished in a direction opposite to the direction of insertion of the bag into said apparatus.

7. A method for keeping a bag opening closed and providing a handle for carrying the bag comprising:

(a) positioning a bag having a closed opening adjacent a frame means having a bend therein at a site immediate its ends to form a slot means for receiving said bag and a non-spring-biased locking member in the vicinity of the bend on the frame means locatable in a position which enables entry between itself and the bent portion of said frame means (b) positioning said locking member to provide an entry space for said bag (c) moving the frame means relative to the closed opening of the bag so that the bent portion of said frame means is placed thereon (d) moving the locking member into a position to maintain the closed opening of the bag against the bent portion of the frame means after the bag is moved into the entry space and (e) re-orientating the frame means while the locking member is maintaining the bag against the frame means to turn a portion of the closed opening of the bag approximately back on itself and positioning a handle means on the frame means so that it can be readily grasped for carrying the bag, said reorienting allowing the force of the weight of the bag on the locking member to pull the locking member into locking engagement with said frame means against the bag, and wherein said placing includes an extending of said locking member transversely of said frame means for supporting the bag and a rotating of said locking member for gripping the bag.

8. A bag and package carrier comprising:

(a) a frame having a first end formed to serve as a handle and a second end formed to serve as a pivot, said frame being bent at a site intermediate said first and said second ends to form a slot means for receiving bag and tie material;

(b) a rotatable member mounted for rotation about said pivot and extending transversely from said slot means, said member having a guide and bag engagement means extending outwardly in differing directions from an axis of said rotation; and wherein (c) said guide is activated by rotation of said member to a first orientation relative to said frame for admission of the tie material into said slot means, said engagement means being activated for gripping a bag upon rotation of said member from said first orientation in the direction opposite to the direction for receiving the tie material to said slot means.

9. A carrier according to claim 8 wherein said frame is disposed at said slot means for engagement with said engagement means upon said rotation of said member from said first orientation to accomplish said gripping of the bag thereby permitting the weight of the bag to lock said member in a bag gripping position.

* * * * *